US009868148B2

(12) United States Patent
Hauw

(10) Patent No.: US 9,868,148 B2
(45) Date of Patent: Jan. 16, 2018

(54) CYLINDER FOR STORING RINGS

(71) Applicant: Aerolia, Toulouse (FR)

(72) Inventor: Philippe Hauw, Sailly Laurette (FR)

(73) Assignee: Aerolia, Toulouse (FR)

( * ) Notice: Subject to any disclaimer, the term of this patent is extended or adjusted under 35 U.S.C. 154(b) by 28 days.

(21) Appl. No.: 14/961,585

(22) Filed: Dec. 7, 2015

(65) Prior Publication Data

US 2016/0167109 A1 Jun. 16, 2016

(30) Foreign Application Priority Data

Dec. 11, 2014 (FR) ..... 14 62239

(51) Int. Cl.

| | |
|---|---|
| ***B21J 15/32*** | (2006.01) |
| ***B21J 15/02*** | (2006.01) |
| ***B21J 15/10*** | (2006.01) |
| *B21J 15/14* | (2006.01) |

(52) U.S. Cl.

CPC ..... *B21J 15/022* (2013.01); *B21J 15/10* (2013.01); *B21J 15/32* (2013.01); *B21J 15/14* (2013.01); *Y10T 29/49943* (2015.01)

(58) Field of Classification Search

CPC ... B21J 15/02; B21J 15/04; B21J 15/06; B21J 15/10; B21J 15/14; B21J 15/30; F16B 5/04; F16B 37/062; Y10T 29/49943; B23Q 7/106

See application file for complete search history.

(56) References Cited

U.S. PATENT DOCUMENTS

| | | | | |
|---|---|---|---|---|
| 392,761 | A | 11/1888 | Schillmöller | |
| 2,256,012 | A | 9/1941 | Blair | |
| 4,586,405 | A | 5/1986 | Berecz | |
| 2010/0260572 | A1 * | 10/2010 | Wehrmeister ..... | F16B 4/004 411/43 |

FOREIGN PATENT DOCUMENTS

| | | | | |
|---|---|---|---|---|
| WO | WO 2005077568 A1 * | 8/2005 | ..... | B21J 15/043 |
| WO | WO 2006/056255 | 6/2006 | | |

* cited by examiner

*Primary Examiner* — Jermie Cozart

(74) *Attorney, Agent, or Firm* — Klein, O'Neill & Singh, LLP

(57) ABSTRACT

A cylinder for storing a plurality of rings to be crimped, said cylinder comprising a base body including a distribution outlet, a main cylindrical body mounted so that it can rotate along a cylinder axis relative to said base body in a plurality of angular positions, said main cylindrical body comprising a plurality of sheaths which are parallel to one another and each suitable for accommodating a plurality of rings, each sheath being arranged so as to lead to said distribution outlet of said base body for a predetermined angular position of said main cylindrical body.

8 Claims, 6 Drawing Sheets

CYLINDER FOR STORING RINGS

GENERAL TECHNICAL FIELD AND PRIOR ART

The present invention relates to the field of crimping of a ring on an attachment rod in order to form a riveted connection, in particular, in the aeronautics field.

In order to secure two elements together, for example, two metal sheets, it is known to use an automaton to place rivets or the like in predetermined securing areas. The automaton can assume an inclined position, rotate or lengthen in order to reach different and various securing areas. Automaton is understood to mean a mechanical device capable of working in an automatic manner, that is to say without human intervention.

The automaton is supplied with rivets or the like through a pneumatic supply duct in order to guide the rivets from a storage site (storage bowl, storage cassette, etc.) to the automaton. In practice, the pneumatic supply duct can have a length between 5 m and 25 m. Such a pneumatic duct is satisfactory for rivets or for a cylindrical ring, but it is not suitable for a flanged ring. Indeed, in reference to FIG. 1, a flanged ring 1 comprises a cylindrical body 11 extending axially along an axis X1 and a radial crown 12 at one of its ends which forms a flange. If a flanged ring 1 is introduced into a pneumatic duct 13 extending along an axis Xc, the flanged ring 1 is capable of assuming an inclined position during its transport in the pneumatic duct 13. The pneumatic duct 13 is then blocked and a maintenance operation needs to be performed, which considerably slows the securing operations. Finally, the flanged rings 1 can become damaged during the supplying, which presents another disadvantage.

Thus, the aim of the invention is to remedy these disadvantages by proposing a novel system for distributing rings, whose reliability is increased and whose maintenance is facilitated, and which can be adapted to flanged rings.

GENERAL PRESENTATION OF THE INVENTION

For this purpose, the invention relates to a cylinder for storing a plurality of rings to be crimped, said cylinder comprising a base body including a distribution outlet, a main cylindrical body mounted so that it can rotate along a cylinder axis relative to said base body in a plurality of angular positions, said main cylindrical body comprising a plurality of sheaths which are parallel to one another and each suitable for accommodating a plurality of rings, each sheath being arranged so as to lead to said distribution outlet of said base body for a predetermined angular position of said main cylindrical body.

Advantageously, the sheaths make it possible to store a plurality of rings which are easy to distribute, while avoiding a risk of blockage as in the prior art. The rotation of the cylindrical body enables each sheath to be aligned successively with the distribution outlet in order to rapidly distribute a large number of rings. Such a storage cylinder is particularly suitable for storing and distributing flanged rings without risk of blockage.

The cycle duration for supplying a ring is advantageously decreased. In addition, such a cylinder makes it possible to store a large number of rings while at the same time having a compact design. Finally, any risk of damaging a ring is prevented.

Preferably, the storage cylinder comprises means for applying pressure to the sheath leading to said distribution outlet. Thus, the storage cylinder can distribute rings independently of the orientation of the storage cylinder, particularly when the distribution outlet is directed upwards.

The angular separation between two consecutive sheaths is preferably constant in order to switch sheaths rapidly by simple rotation.

According to a preferred aspect, at least one angular position of the main cylindrical body is a rest position so as to avoid an unintentional distribution of rings when handling the storage cylinder.

Preferably, the cylinder comprises blocking means configured for preventing any rotation of said cylindrical body relative to said base body about the axis of the cylinder in said rest position. Thus, any unintentional rotation of the storage cylinder is prevented.

The cylinder advantageously comprises at least one distribution device suitable for preventing the passage of a ring through the distribution outlet. Thus, the distribution device, preferably a distribution gripper, makes it possible to control the rate of distribution and to distribute each ring individually.

The invention also relates to an assembly of a storage cylinder as presented above and of a plurality of flanged rings accommodated in the plurality of sheaths.

Moreover, the invention relates to a crimping module comprising a storage cylinder so that the rings to be crimped are taken up directly in the crimping module in order to decrease the duration of the supplying.

The crimping module advantageously comprises a chassis, a storage cylinder as presented above mounted in said chassis, and a mechanism for rotating the main cylindrical body relative to said base body along the cylinder axis. Thus, the crimping module makes it possible to distribute the rings located in the sheaths of the storage cylinder in a controlled manner.

The crimping module preferably comprises a mechanism for crimping a ring on an attachment rod, preferably a crimping nose.

The crimping module advantageously comprises a mechanism for positioning a ring on an attachment rod. Preferably, the positioning mechanism comprises at least one receiving finger suitable for extending at least partially into said distribution outlet. Thus, the receiving finger makes it possible to temporarily receive a ring between its distribution and its placement on an attachment rod.

Preferably, the positioning mechanism comprises at least one movement gripper suitable for gripping a ring and moving it in a precise manner onto the attachment rod from its distribution site. It is also preferable if the positioning mechanism comprises profile tracking means in order to guide the movement of the movement gripper in order to slide it onto the attachment rod.

The invention also relates to an automaton for crimping a ring, comprising at least one mobile arm including a head and at least one crimping module, as presented above, mounted on said head. Thus, a ring can be crimped in an automated manner on attachment rods whose position and orientation can be different and various.

The invention also relates to a method for distributing at least one ring by a crimping module as presented above, a sheath of the storage cylinder being aligned with said distribution outlet, the method comprising:

- a step of opening the distribution outlet so as to allow the travel of a ring from the sheath through said distribution outlet;
- a step of receiving said ring on a receiving finger;

a step of closing said distribution outlet so as to prevent the travel of rings from said sheath through said distribution outlet; and a step of gripping said ring received on said receiving finger in order to move it.

Thus, the distribution method makes it possible to rapidly distribute the rings individually from the storage cylinder while facilitating their supply to the crimping site.

PRESENTATION OF THE FIGURES

The invention will be better understood based on the reading of the following description which is given only as an example and which refers to the appended drawings in which.

It should be noted that the figures disclose the invention in a detailed manner for implementing the invention; said figures can naturally be used to better define the invention where appropriate.

DESCRIPTION OF ONE OR MORE EMBODIMENTS AND IMPLEMENTATIONS

Figure 2:
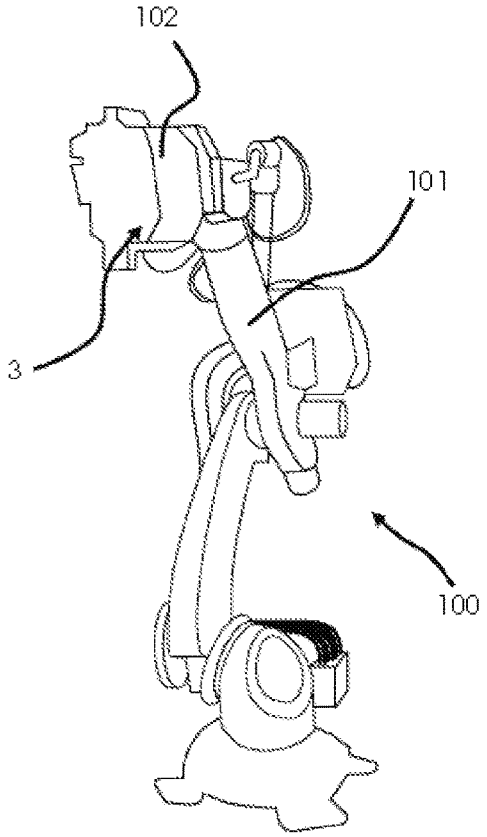
FIG. 2 is a diagrammatic representation of an automaton according to the invention for crimping a ring on an attachment rod.

The invention will be presented in reference to FIG. 2 which shows a crimping automaton 100 comprising a preferably articulated mobile arm 101, which includes a head 102 on which a crimping module 3 is mounted. The automaton 100 makes it possible to crimp a ring on an attachment rod in order to form a riveted connection.

Figure 3:
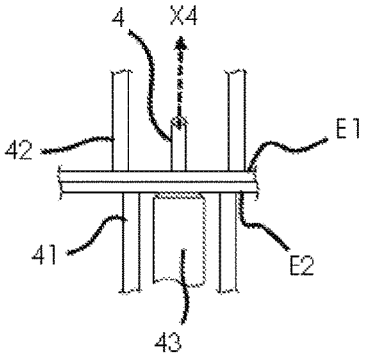
FIG. 3 is a diagrammatic representation of an attachment rod passing through two panels to be secured before a crimping step.

As an example, in reference to FIG. 3, two panels E1, E2 of an aircraft fuselage are represented, through which passes an attachment rod 4 which includes a protruding end extending longitudinally along a crimping axis X4 oriented vertically from the bottom to the top. In this example, the attachment rod 4 extends vertically; however, it could naturally extend in any direction.

In this example, the aeronautic panels E1, E2 are held against one another by stressing means 41, 42, while the attachment rod 4 is held by blocking means 43 known to the person skilled in the art or by another automaton.

Advantageously, the head 102 of the automaton 100 can be oriented along a plurality of axes and the arm 101 is mobile in a plurality of directions in order to crimp rings on a large number of attachment rods 4 which are more or less remote from the automaton 100 and whose crimping axes X4 are oriented in different and various manners.

An automaton 100 for crimping flanged rings 1 will be represented; however, the automaton 100 can naturally be suitable for crimping different types of rings, particularly cylindrical rings.

Figure 1:
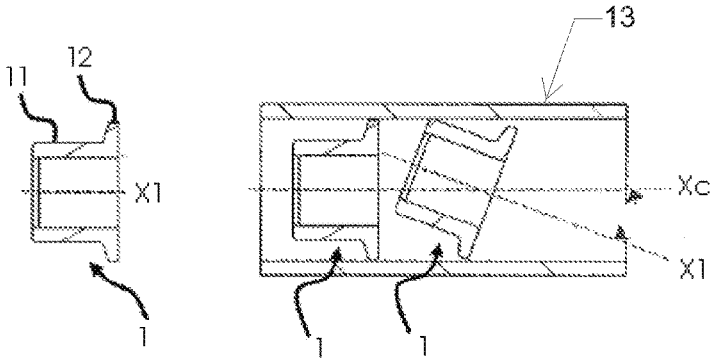
FIGURE 1 PRIOR ART
FIG. 1 is a diagrammatic cross-sectional view of flanged rings during their transport in a pneumatic duct according to the prior art.

As presented in the preamble, a flanged ring 1 comprises a cylindrical body 11 extending axially along an axis X1 and a radial crown 12 at one of its ends, which forms a flange as illustrated in FIG. 1. During the crimping of a flanged ring 1, its radial crown 12 needs to be positioned against the aeronautic panel E1.

Figure 4:
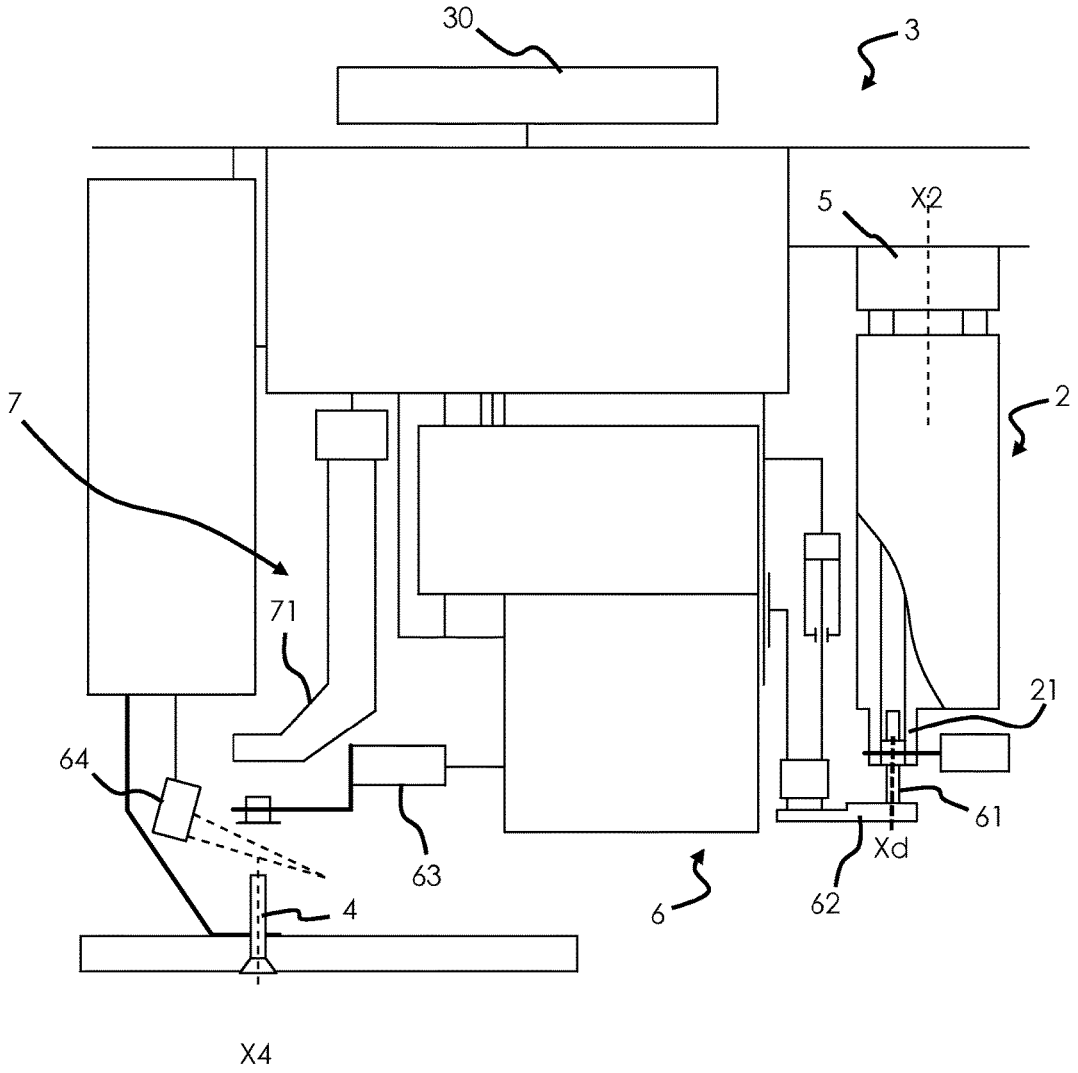
FIG. 4 is a functional diagrammatic representation of the crimping module of the automaton of FIG. 3.

In this example, in reference to FIG. 4, the crimping module 3 of the automaton 100 comprises:

a structural chassis 30 secured to the head 102 of the automaton 100;

a storage cylinder 2;

a mechanism 5 for rotating said storage cylinder 2;

a mechanism 6 for positioning a ring 1 on an attachment rod 4; and a mechanism 7 for crimping a ring 1 on an attachment rod 4.

The storage cylinder 2 is mounted in a removable manner in the crimping module 3 so that it can be replaced by a new storage cylinder 2 when all the flanged rings 1 have been distributed. Each element of the crimping module 3 will be presented below.

Figure 5:
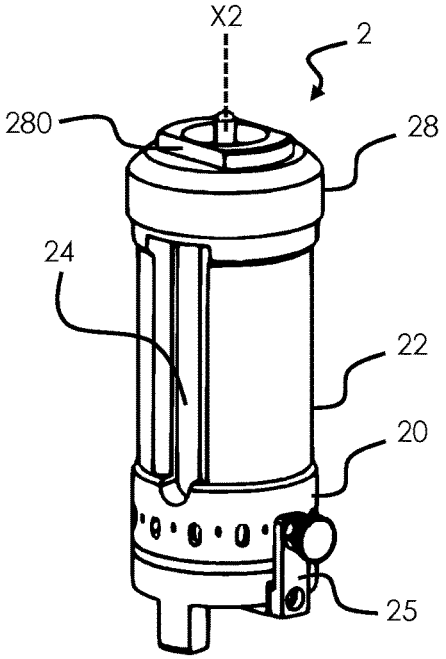
FIG. 5 is a perspective representation of a cylinder for storing rings according to the invention.
Figure 6:
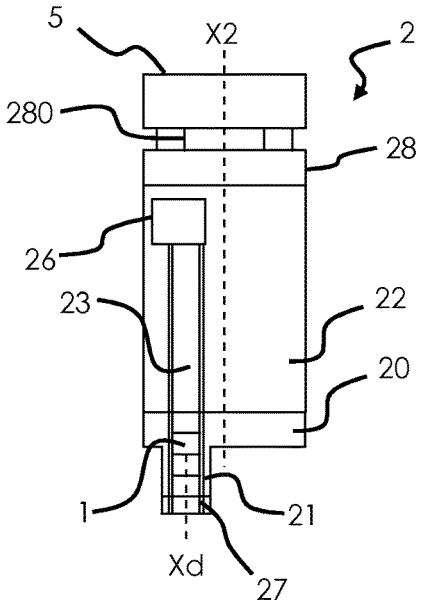
FIG. 6 is a functional diagrammatic representation of the cylinder of FIG. 5 with its rotation mechanism.

In reference to FIGS. 5 and 6, the storage cylinder 2 includes a main cylindrical body 22 which extends axially along a cylinder axis X2 and which includes a plurality of sheaths 23 parallel to one another and to said cylinder axis X2. For the sake of clarity, only one sheath 23 is represented in FIG. 6.

Each sheath 23 is cylindrical and suitable for accommodating a plurality of rings 1, particularly flanged rings 1 stacked consecutively. In this example, the cylindrical body 22 has a circular cross section, but the cross section could naturally be different.

In addition to its main cylindrical body 22, the cylinder 2 includes a base body 20 and a head body 28 which are mounted at the ends of the cylindrical body 22. The base body 20 comprises a distribution outlet 21, in order to allow the distribution of rings 1 along a distribution axis Xd parallel to the cylinder axis X2. The main cylindrical body 22 is mounted so that it can rotate about the cylinder axis X2 relative to said base body 20 in a plurality of angular positions. Each sheath 23 of the main cylindrical body 22 is arranged so as lead to said distribution outlet 21 for a predetermined angular position. The angular separation between two consecutive angular positions is preferably constant in order to facilitate the successive passage of the sheaths 23 in front of the distribution outlet 21. In this example, the cylinder 2 makes it possible to define twelve different angular positions separated by a 30° angle.

In reference to FIG. 6, the rings 1 are stacked axially and oriented in a sheath 23 so that their cylindrical crowns 12 are turned towards the distribution outlet 21 of the storage cylinder 2.

At least one angular position of the main cylindrical body 22 preferably corresponds to a rest position of the storage cylinder 2. In particular, in this rest position, the distribution outlet 21 is not aligned with a sheath 23 in order to avoid any unintentional distribution during the handling of the storage cylinder 2, particularly during its replacement. In this example, in reference to FIG. 5, the main cylindrical body 22 comprises a notch 24 instead of a sheath 23 filled with flanged rings 1, said notch 24 not being suitable for accommodating flanged rings 1. In other words, in this embodiment, the storage cylinder 2 comprises eleven sheaths 23 corresponding to eleven angular positions of use of the storage cylinder 2, the twelfth angular position being a rest position.

In reference to FIG. 5, the storage cylinder 2 preferably comprises at least one locking device 25 configured so as to prevent any relative movement between said main cylindrical body 22 and said base body 20. In particular, in rest position, the storage cylinder 2 makes it possible to prevent a sheath 23 from being aligned with the distribution outlet 21 in order to prevent any unintentional distribution of a flanged ring 1 by the storage cylinder 2. In this example, the locking device 25 is in the form of a locking pin, but it could naturally be different.

In reference to FIG. 6, the storage cylinder 2 comprises, in addition, means 26 for applying pressure to the sheath 23 which is active, that is to say it leads to said distribution outlet 21 in order to enable the driving of the rings 1 from the sheath 23 towards said distribution outlet 21 along the distribution axis Xd, independently of the orientation of the storage cylinder 2. Thus, if the storage cylinder 2 is oriented vertically towards the top with the base body 20 in the upper portion, the pressure application means 26 make it possible to oppose gravity and drive the flanged rings 1 from the sheath 23 to the distribution outlet 21. In this example, the pressure application means 26 are pneumatic, but they could naturally be different.

Still in reference to FIG. 6, the storage cylinder 2 comprises at least one closing device 27, which is suitable for gripping a ring 1 at the distribution outlet 21 in order to control the distribution of the flanged rings 1 from a sheath 23. In this example, the closing device 27 is in the form of a distribution gripper having at least two positions: a closed position in which the distribution gripper is suitable for gripping a ring 1 on its periphery thus blocking the passage of rings 1 through the distribution outlet 21, and an open position in which the distribution gripper is suitable for allowing the passage of rings 1 through the distribution outlet 21. Preferably, the closing device 27 is suitable for detecting whether a ring 1 is present in closed position.

The head body 28 of the storage device 2 is suitable for closing the access to the sheaths 23 of the main cylindrical body 22. The head body 28 is rotatably secured to the main cylindrical body 22. Moreover, head body 28 preferably comprises angular orientation means 280 suitable for being driven in angular rotation and modifying the angular position of the main cylindrical body 22 relative to the base body 20. In this embodiment, in reference to FIG. 5, the angular orientation means 280 are in the form of one or more flat spots, but they could naturally be in a different form.

The storage cylinder 2 preferably comprises means for detecting the presence of rings 1 in a sheath 23 in order to determine whether a new sheath 23 needs to be aligned with said distribution outlet 21.

The storage ring 2 preferably also comprises detachable means for mounting in the chassis 30 of the crimping module 3.

As presented above, in reference to FIG. 4, the crimping module 3 of the automaton 100 also comprises a mechanism 5 for rotating the storage cylinder 2. In this example, the rotation mechanism 5 is in the form of an actuator mounted in the chassis 30 and suitable for cooperating with the flat spots of the head body 28 of the storage cylinder 2 and driving it in rotation about the cylinder axis X2.

In reference to FIG. 4, the crimping module 3 of the automaton 100 also comprises a mechanism 6 for positioning a ring 1 on an attachment rod 4.

The positioning mechanism 6 is configured so as to recover a flanged ring 1 from the storage cylinder 2 and position it on an attachment rod 4 before being crimped by the crimping mechanism 7 which will be presented below.

In reference to FIG. 4, the positioning mechanism 6 comprises at least one receiving finger 61 suitable for extending at least partially into said distribution outlet 21 of the storage cylinder 2. In this example, the receiving finger 61 is mobile and suitable for moving at least along the distribution axis Xd in a retracted position in which the receiving finger 61 extends at least partially into said distribution outlet 21, and an extended position in which the receiving finger 61 extends out of said distribution outlet 21 in order to provide a clearance space between the receiving finger 61 and said distribution outlet 21. In reference to FIG. 6, the receiving finger 61 extends coaxially to the distribution axis Xd.

The positioning mechanism 6 preferably comprises a receiving plate 62 extending transversely to the receiving finger 61, in order to receive a flanged ring 1 as will be presented below.

Still in reference to FIG. 4, the positioning mechanism 6 comprises at least one movement gripper 63 suitable for gripping a flanged ring 1 and moving it in a precise manner onto an attachment rod 4 situated in the vicinity of the crimping module 3 of the automaton 100. Preferably, the movement gripper 63 is suitable for moving in translation along the three axes and suitable for rotating along at least one axis parallel to the distribution axis Xd of the storage cylinder 2.

In order to enable a precise positioning of the flanged ring 1 on an attachment rod 4, the positioning mechanism 6 comprises, in addition, profile tracking means configured for detecting the position of an attachment rod 4 relative to the reference of the crimping module 3 and for enabling the guiding of the movement gripper 63 so that it can slide the flanged ring 1 onto the attachment rod 4, as will be presented below. In this example, the profile tracking means are in the form of a profilometer 64 configured for detecting by ultrasound or by laser beam.

The profilometer 64 makes it possible to control the movement of the movement gripper 63 relative to the position of the attachment rod 4. The control is preferably carried out by means of cross tables steered for guiding the movement gripper 63 in the plane transverse to the attachment rod 4.

In this embodiment example, in reference to FIG. 4, the crimping mechanism 7 is in the form of a crimping nose 71 configured for crimping said flanged ring 1 on said attachment rod 4. The crimping nose 71 is suitable for moving along three axes relative to the chassis 30 of the crimping module 3.

Such a crimping nose 71 is known to the person skilled in the art and will not be presented in further detail. Naturally, the crimping mechanism 7 could be in a different form. In this example, the crimping nose 71 is aligned with the axis X4 of the attachment rod 4 and mounted with translation relative to the chassis 30 of the crimping module 3 so as to allow the crimping by translation along the axis X4.

The movement gripper 63 is preferably configured in order to detect whether an object is inserted between its jaws, which makes it possible to avoid a step of crimping by the crimping nose 71 in the absence of a flanged ring 1 on the attachment rod 4.

In reference to FIGS. 7 to 13, the storage cylinder 2 is in an angular position of use, that is to say a sheath 23 of the main cylindrical body 22 is aligned with the distribution outlet 21 of the base body 20. The flanged rings 1 of the sheath 23, which are stacked along the distribution axis Xd, are forced by the pressure application means 26 towards the distribution outlet 21.

Figure 7:
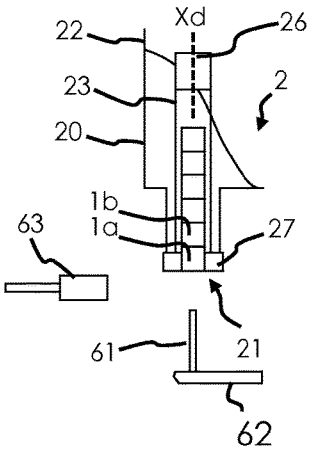
FIGS. 7 to 13 are successive diagrammatic representations of a method for the distribution of a ring by the storage cylinder.

As illustrated in FIG. 7, the flanged ring 1 situated in the distribution outlet 21 is blocked by the distribution device 27 which grips its periphery. Thus, the flanged rings 1 of the sheath 23 abut against the flanged ring 1 gripped by the distribution device 27 referred to below as "ring to be crimped a1" for the sake of brevity. In the same way, the flanged ring adjacent to the ring to be crimped 1*a* is referred to as "next ring 1*b*."

In this position, the receiving finger 61 is in extended position, the receiving finger 61 extending out of said distribution outlet 21 in order to provide a clearance space between the receiving finger 61 and said distribution outlet 21.

Figure 8:
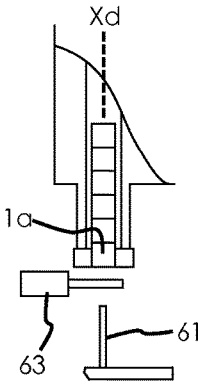

In order to distribute the ring to be crimped 1*a*, the movement gripper 63 is open and placed in the clearance space, that is to say along the distribution axis Xd at a distance from the distribution outlet 21 as illustrated in FIG. 8.

Figure 9:
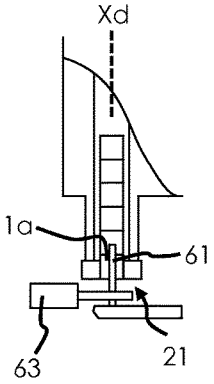

Then, the receiving finger 61 is moved along the distribution axis Xd in retracted position in order to be introduced into the ring to be crimped 1*a* situated in the distribution outlet 21 as illustrated in FIG. 9.

Figure 10:
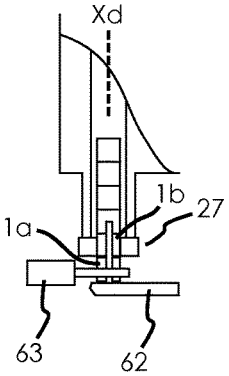

Then, in reference to FIG. 10, the method comprises a release step in which the distribution device 27 is opened so as to release the ring to be crimped 1*a* which moves along the distribution axis Xd under the action of the pressure application means 26. The flanged rings 1 of the sheath 23 then abut against the receiving plate 62. The distance between the receiving plate 62 and the distribution outlet 21 is preferably calibrated so that the next flanged ring 1*b* is situated at the site of the distribution device 27 as illustrated in FIG. 10.

Figure 11:
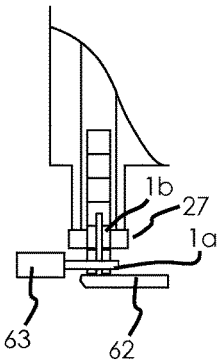

Next, in reference to FIG. 11, the method comprises a blocking step in which the distribution device 27 is closed so as to grip the periphery of the next ring 1*b*. Thus, the flanged rings 1 of the sheath 23 abut against the next ring 1*b*.

As for the ring to be crimped 1*a*, it is gripped by the movement gripper 63 which closes and grips its periphery as illustrated in FIG. 11. By means of the receiving finger 61, the position of the ring to be crimped 1*a* is defined in a precise manner, and the movement gripper 63 can reliably grip the ring to be crimped 1*a*.

Figure 12:
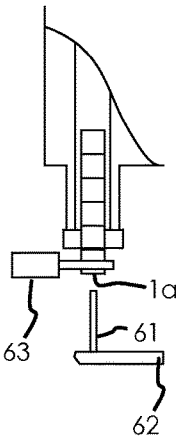
Figure 13:
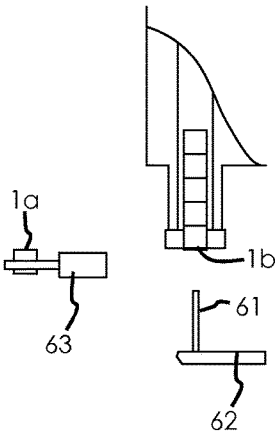

Then, in reference to FIG. 12, the receiving finger 61 is moved into extended position in order to release the ring to be crimped 1*a*, which can be moved by the movement gripper 63 to the crimping site as illustrated in FIG. 13. Thus, the receiving plate 62 makes it possible to temporarily store a ring after its distribution by the storage cylinder 2.

Such a distribution method is advantageous, because it enables a ring to be crimped 1*a* to be supplied in a precise manner in a compact environment.

When a sheath 23 of the storage cylinder 2 is empty, the head body 28 of the storage cylinder 2 is moved in rotation by the rotation mechanism 5 of the crimping module 3 about the cylinder axis X2 so that a new sheath 23, filled with flanged rings 1, is aligned with the distribution outlet 21. When all the sheaths 23 are empty, the rotation mechanism 5 moves the head body 28 so that the storage cylinder 2 is in rest position. The notch 24 is then aligned with the distribution outlet 21.

Then, the locking device 25 of the storage cylinder 2 is activated so as to prevent any rotation of the cylindrical body 22 and thus to enable the removal of the storage cylinder 2 from the crimping module 3 and its replacement by a new storage cylinder 2 filled with flanged rings 1. Such a replacement is simple and rapid to carry out.

An empty cylinder 2 is preferably filled by means of a resupply machine which introduces flanged rings 1 successively and in automated manner into each of the sheaths 23 of said storage cylinder 2.

Below, several steps will be presented for rapidly and reliably crimping a flanged ring 1 on an attachment rod 4.

First, a step of preliminary positioning of the automaton 100 is carried out. For this purpose, the mobile arm 101 of the automaton 100 is moved so as to move and orient the head 102 of the automaton 100 so that the chassis 30 of the crimping module 3 is positioned close to the attachment rod 4 and oriented precisely relative to the axis X4 of the attachment rod 4. In this example, in reference to FIG. 4, once the automaton 100 is in position, the distribution axis Xd is parallel to the attachment axis X4, and the distribution outlet 21 is situated at least 1 cm from the attachment rod 4, preferably about 5 mm. After the positioning, the reference of the chassis 30 of the crimping module 3 is positioned in a precise and predetermined manner relative to the reference of the attachment rod 4, which facilitates the positioning of a ring 1 on the attachment rod 4. As presented above, the crimping module comprises stressing means 41, 42 for holding the panels E1, E2 together and blocking means 43 for holding the attachment rod 4 so that it protrudes.

Figure 14:
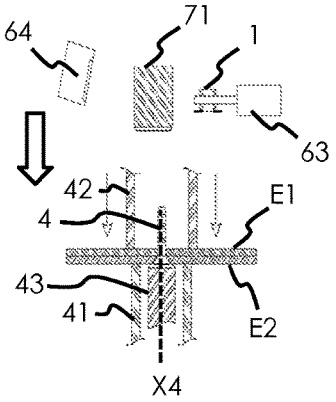
FIGS. 14 to 23 are successive diagrammatic representations of a method for crimping a ring on an attachment rod.
Figure 15:
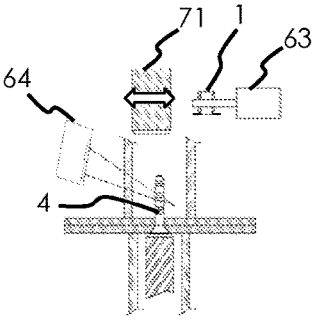

In reference to FIG. 14, the attachment rod 4 is held firmly in order to extend protruding from the panels E1, E2. Then, in reference to FIG. 15, the profilometer 64 of the crimping module 3 is brought close to the attachment rod 4 in order to detect the end and the center of the attachment rod 4, which makes it possible to determine the axis along which the attachment rod 4 extends and thus to facilitate the positioning of the movement gripper 63 and of the crimping nose 71 along this axis so as to move the ring 1 without damage onto the attachment rod 4.

Figure 16:
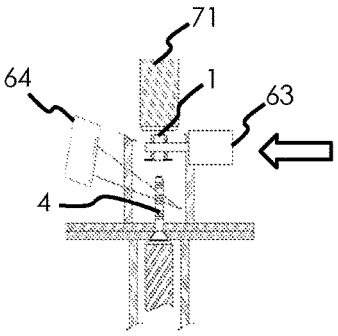
Figure 17:
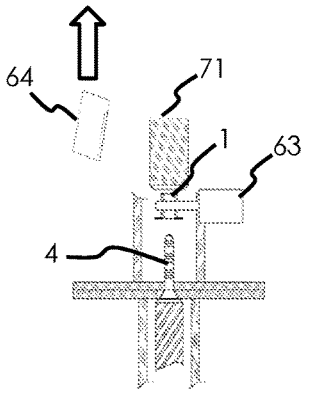

Then, the crimping nose 71 is moved so as to be aligned with the axis X4 of the attachment rod 4 based on the data supplied by the profilometer 64. Consecutively or simultaneously, the movement gripper 63, in which a flanged ring 1 is held, is positioned between the crimping nose 71 and the attachment rod 4 as illustrated in FIG. 16. The profilometer 64 can then be raised as illustrated in FIG. 17.

Figure 18:
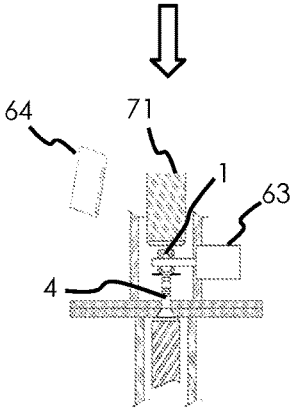

Then, the crimping nose 71 and the movement gripper 63 are moved simultaneously along the axis X4 of the attachment rod 4 so that the flanged ring 1 is blocked in translation on the attachment rod 4, any withdrawal being prohibited by the crimping nose 71 as illustrated in FIG. 18. The cylindrical crown 12 of the flanged ring 1, that is to say its flange, is situated on the side of the attachment rod 4.

In contrast to a supply by blowing, the flanged ring 1 is advantageously positioned and held before the crimping, independently of the orientation of the attachment rod 4. By means of the crimping method according to the invention, an attachment rod 4 that is oriented downward can be crimped, the movement gripper 63 making it possible to be free of gravity.

Figure 19:
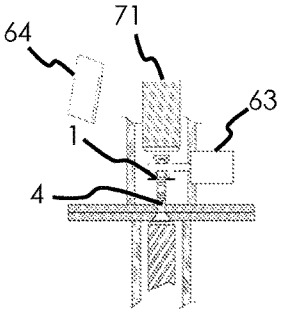
Figure 20:
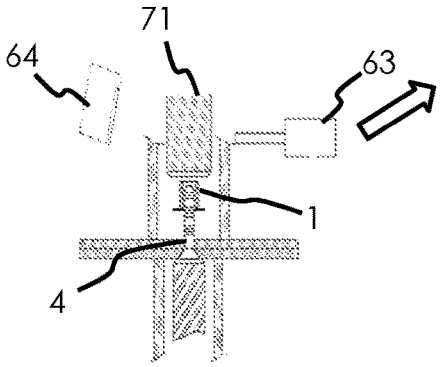

In reference to FIG. 19, the movement gripper 63 is opened so as to release the flanged ring 1 whose movements are limited by the attachment rod 4 and the crimping nose 71. The movement gripper 63 can then be released as illustrated in FIG. 20.

Figure 21:
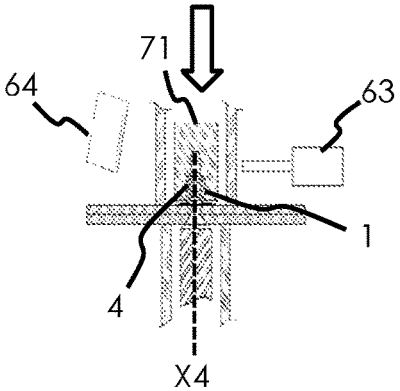
Figure 22:
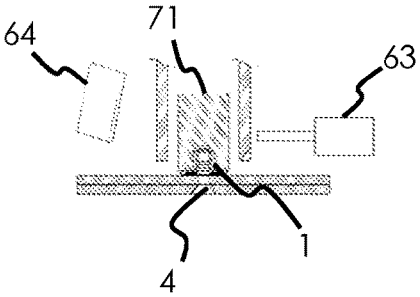
Figure 23:
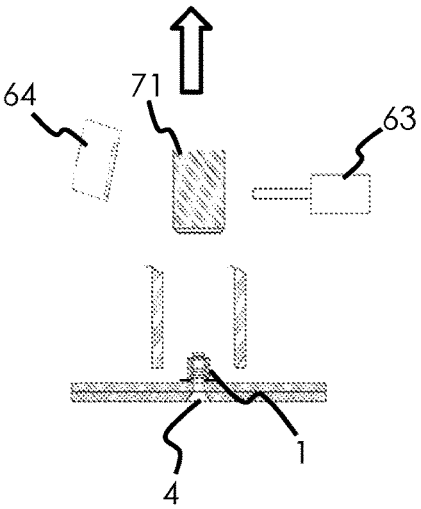

As illustrated in FIG. 21, the crimping nose 71 is moved along the attachment axis X4 in the direction of the attachment rod 4 in order to deform the flanged ring 1 against the first panel E1. During the crimping, the flanged ring 1 is secured to the attachment rod 4. Preferably, the protruding portion of the attachment rod 4 breaks during the crimping step in order to form a robust connection of reduced mass as illustrated in FIG. 22. The crimping being completed, the crimping module 3 of the automaton 100 is moved, as illustrated in FIG. 23, in order to crimp a new flanged ring 1 on another attachment rod 4.

By means of the invention, several rings 1 can be crimped consecutively and in an automated manner in order to form quality riveted connections, particularly for securing panels of an aircraft fuselage.

The invention claimed is:

1. A crimping module comprising:

a cylinder for storing a plurality of rings to be crimped, said cylinder comprising a base body including a distribution outlet, a main cylindrical body mounted rotatably along a cylinder axis relative to said base body in a plurality of angular positions, said main cylindrical body comprising a plurality of sheaths which are parallel to one another and each suitable for accommodating a plurality of rings, each sheath being arranged so as to lead to said distribution outlet of said base body for a predetermined angular position of said main cylindrical body; and a mechanism for positioning a ring on an attachment rod, the positioning mechanism comprising at least one receiving finger suitable for extending at least partially into the distribution outlet of the cylinder.

2. The crimping module according to claim 1, wherein the cylinder comprises means for applying pressure to the sheath leading to said distribution outlet.

3. The crimping module according to claim 1, wherein the cylinder comprises at least one distribution device suitable for preventing the passage of a ring through the distribution outlet.

4. The crimping module according to claim 1, further comprising a plurality of flanged rings accommodated in the plurality of sheaths.

5. The crimping module according to claim 1, further comprising a mechanism for crimping a ring on an attachment rod.

6. The crimping module according to claim 1, further comprising at least one movement gripper suitable for gripping a ring and moving said ring on the attachment rod.

7. The crimping module according to claim 6, further comprising profile tracking means so as to guide the movement of the movement gripper so as to slide said movement gripper onto the attachment rod.

8. An automaton for crimping a ring, comprising at least one mobile arm including a head and at least one crimping module mounted on said head, the crimping module comprising:

a cylinder for storing a plurality of rings to be crimped, said cylinder comprising a base body including a distribution outlet, a main cylindrical body mounted rotatably along a cylinder axis relative to said base body in a plurality of angular positions, said main cylindrical body comprising a plurality of sheaths which are parallel to one another and each suitable for accommodating a plurality of rings, each sheath being arranged so as to lead to said distribution outlet of said base body for a predetermined angular position of said main cylindrical body; and a mechanism for positioning a ring on an attachment rod, the positioning mechanism comprising at least one receiving finger suitable for extending at least partially into the distribution outlet of the cylinder.

* * * * *